US011431104B2

(12) United States Patent
Watson

(10) Patent No.: US 11,431,104 B2
(45) Date of Patent: Aug. 30, 2022

(54) ANTENNA ARRAY WITH SELF-CANCELLING CONDUCTIVE STRUCTURE

(71) Applicant: Paul Robert Watson, Ottawa (CA)

(72) Inventor: Paul Robert Watson, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 161 days.

(21) Appl. No.: 16/921,480

(22) Filed: Jul. 6, 2020

(65) Prior Publication Data

US 2022/0006203 A1 Jan. 6, 2022

(51) Int. Cl.

| | |
|---|---|
| ***H01Q 19/02*** | (2006.01) |
| ***H01Q 21/06*** | (2006.01) |
| ***H01Q 9/04*** | (2006.01) |

(52) U.S. Cl.

CPC ..... *H01Q 19/028* (2013.01); *H01Q 9/045* (2013.01); *H01Q 21/061* (2013.01); *H01Q 21/065* (2013.01)

(58) Field of Classification Search

CPC .... H01Q 21/065; H01Q 1/523; H01Q 19/108; H01Q 5/48; H01Q 21/061; H01Q 25/001; H01Q 1/241; H01Q 9/0428; H01Q 9/065; H01Q 9/285; H01Q 19/028; H01Q 9/045

See application file for complete search history.

(56) References Cited

U.S. PATENT DOCUMENTS

| | | | | |
|---|---|---|---|---|
| 10,998,640 | B2 * | 5/2021 | Carey | H01Q 21/0087 |
| 2017/0062952 | A1 * | 3/2017 | Sundararajan | H01Q 1/246 |
| 2017/0194703 | A1 * | 7/2017 | Watson | H01Q 1/523 |
| 2017/0222315 | A1 | 8/2017 | Hozouri | |
| 2019/0356057 | A1 * | 11/2019 | Carey | H01Q 3/30 |
| 2020/0153116 | A1 | 5/2020 | Onaka et al. | |

FOREIGN PATENT DOCUMENTS

| | | | |
|---|---|---|---|
| CN | 103580720 | A | 2/2014 |
| CN | 106532261 | A | 3/2017 |
| CN | 107546488 | A | 1/2018 |
| KR | 20150051718 | A * | 5/2015 |

OTHER PUBLICATIONS

Written Opinion—PCT/CN2021/103377 (Year: 2021).*

Watson, Paul, "A Full Duplex Massive MIMO Array with 2-Dimensional Self-Cancelling Network", Powerpoint presentation, Oct. 15, 2018.

* cited by examiner

*Primary Examiner* — Vibol Tan

(57) ABSTRACT

An antenna array capable of full duplex communication is described. The antenna array includes a first dual polarity antenna element and a second dual polarity antenna element. A first conductive structure, extends between the first and second antenna elements along a diagonal axis in common between the first antenna element and the second element, and forms a coupling path between the first and the second antenna elements such that at least a portion of a signal generated by the first antenna element is coupled, via the coupling path, to the second antenna element to at least reduce cross polarity mutual coupling between the first antenna element and the second antenna element.

20 Claims, 6 Drawing Sheets

ANTENNA ARRAY WITH SELF-CANCELLING CONDUCTIVE STRUCTURE

FIELD

The present disclosure relates to antenna arrays, including antenna arrays with structures for self-cancellation of mutual coupling. Such antenna arrays may be useful for full duplex communications in a wireless network.

BACKGROUND

Full duplex radio technology has been of interest for wireless communications, including for use in fifth-generation (5G) wireless networks, with transmission and reception of radio signals using a common antenna and transceiver. In full duplex communications, transmission signals and reception signals are communicated using the same time-frequency resource (e.g., using the same carrier frequency at the same time). Accordingly, full duplex communication is a technique that may be used to achieve up to double throughput, by enabling transmission and reception simultaneously.

As full duplex communication systems utilize transmission and reception simultaneously on the same frequency at the same time, full duplex antenna arrays feature adjacent transmitting and receiving elements which are prone to self-interference. High isolation is desired between the transmit and receive ports of a full duplex antenna array in order to avoid the problem of self-interference in the received signal. Conventional antenna systems have incorporated a variety of techniques to filter unwanted signals, including self-interference signals, out of the desired received signal. Conventional approaches to achieving this goal include signal processing techniques on the digitized signal.

Self-interference increases in a dense antenna array, such as one meant for massive multiple-input multiple-output (MIMO) functionality, when compared to less dense antenna arrays, and can make digital cancellation techniques computationally demanding or less effective than desired.

There is a need for a better and/or more efficient means of removing or reducing the amount of unwanted coupling between antenna elements in an antenna array.

SUMMARY

In various examples, the present disclosure describes an antenna array, capable of full duplex communication, the antenna array having a first dual polarity antenna element having a diagonal axis and a second dual polarity antenna element having the diagonal axis in common with the first antenna element. The second antenna element is adjacent to the first antenna element along the diagonal axis, and a first conductive structure, extending between the first and second antenna elements along the diagonal axis forms a coupling path between the first and the second antenna elements. The formed coupling path is such that at least a portion of a signal generated by the first antenna element is coupled, via the coupling path, to the second antenna element to at least reduce cross polarity mutual coupling between the first antenna element and the second antenna element.

In any of the above example embodiments, the antenna array first and second antenna elements may be supported by a substrate, and the first conductive structure may be located on a first side of the substrate.

In any of the above example embodiments, the first conductive structure may be a copper conductive structure.

In any of the above example embodiments, the antenna array may have a third dual polarity antenna element, and a fourth dual polarity antenna element, and the first antenna element, second antenna element, third antenna element, and fourth antenna element may form a 2×2 grid. A second conductive structure, extending between the third and fourth antenna elements along a second diagonal axis that is shared by the first and fourth antenna elements, may form a coupling path between the third and the fourth antenna elements such that at least a portion of a signal generated by the third antenna element is coupled, via the coupling path, to the fourth antenna element to at least reduce cross polarity mutual coupling between the third antenna element and the fourth antenna element.

In any of the above example embodiments, the first, second, third and fourth antenna elements may be supported by a substrate, the first conductive structure may be located on a first side of the substrate, and the second conductive structure may be located on a second side of the substrate.

In any of the above example embodiments, the first conductive structure length may be such that the signal generated by the first antenna element arrives at the second antenna element 180° out of phase relative to an over the air signal generated by the first antenna element.

In any of the above example embodiments, the first and the second antenna elements may be supported by a substrate, and the first conductive structure may be connected to a portion of the first antenna element superimposed by a radiating patch element of the first antenna element, and to a portion of the second antenna element superimposed by a radiating patch element of the second antenna element.

In any of the above example embodiments, the first conductive structure may have at least a first arm extending proximate to a perimeter of the portion of the first antenna element superimposed by the radiating patch element of the first antenna element, and at least a second arm extending proximate to a perimeter of the portion of the second antenna element superimposed by the radiating patch element of the second antenna element.

In any of the above example embodiments, the first conductive structure arm extending proximate to the first inner substrate perimeter may have a curved geometry.

In any of the above example embodiments, the first conductive structure arm extending proximate to the first inner substrate perimeter may extend along a first inner substrate perimeter edge short of a midpoint of the perimeter edge.

In any of the above example embodiments, the first antenna element may include a first corner and the second antenna element may include a second corner. The first corner may be adjacent and closest to the second corner, and the first conductive structure may be connected proximate to the first corner and proximate to the second corner.

In any of the above example embodiments, the first and the second antenna elements may be supported by a substrate, and the first conductive structure may extend along a first inner substrate perimeter of the first antenna element and a second substrate perimeter of the second antenna element.

In any of the above example embodiments, the first antenna element may have four corner portions each containing a respective conductive structure.

In any of the above example embodiments, the first conductive element may have a length equal to half an operating wavelength of the antenna array.

In various examples, the present disclosure describes an antenna array capable of full duplex communication has a plurality of antenna elements, arranged in a grid pattern and a plurality of conductive structures. The plurality of conductive structures extends between diagonally adjacent antenna elements of the plurality of antenna elements, forming of a plurality of coupling paths between respective diagonally adjacent antenna elements such that at least a portion of a signal generated by each antenna element is coupled, via the coupling path, to a respective diagonally adjacent antenna element to at least reduce cross polarity mutual coupling between the diagonally adjacent antenna elements.

In any of the above example embodiments, the plurality of antenna elements may include at least a first antenna element and a second antenna element, the first and second antenna elements having a common diagonal axis, the first and second antenna elements being adjacent to each other along the diagonal axis. A first conductive structure, of the plurality of conductive structures, extending between the first and second antenna elements, may have a length such that the signal generated by the first antenna element arrives at the second antenna element 180° out of phase relative to an over the air signal generated by the first antenna element.

In any of the above example embodiments, the plurality of antenna elements may include at least a first antenna element and a second antenna element, the first and second antenna elements having a common diagonal axis, the first and second antenna elements being adjacent to each other along the diagonal axis. A first conductive structure, of the plurality of conductive structures, extending between the first and second antenna elements, may have a length equal to half an operating wavelength of the antenna array.

In any of the above example embodiments, each of the plurality of antenna elements may be shaped to have four corner portions, and each of the plurality of conductive structures may extend between diagonally adjacent corners of respective diagonally adjacent antenna elements.

In any of the above example embodiments, the plurality of antenna elements may include at least a first antenna element and a second antenna element, the first and second antenna elements having a common diagonal axis, the first and second antenna elements being adjacent to each other along the diagonal axis. A first conductive structure, of the plurality of conductive structures, extending between the first and second antenna elements, may be connected to a portion of the first antenna element superimposed by a radiating patch element of the first antenna element, and to a portion of the second antenna element superimposed by a radiating patch element of the second antenna element.

In any of the above example embodiments, the first conductive structure may have at least a first arm extending proximate to a perimeter of the portion of the first antenna element superimposed by the radiating patch element of the first antenna element, and at least a second arm extending proximate to a perimeter of the portion of the second antenna element superimposed by the radiating patch element of the second antenna element.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

In various examples, the present disclosure describes an antenna array having a network of conductors above the ground plane reflector, which result in reducing or nulling of the unwanted couplings between diagonal antenna array elements. The antenna array may comprise dual orthogonal polarity antenna elements. The reduction or nulling of antenna couplings may be achieved over the full two dimensions of a massive multiple-input multiple-output (MIMO) antenna array.

The presently disclosed antenna array may be configured so that there is no significant increase in array depth required to achieve the self-cancellation effects, and only incremental complexity is added to the antenna array.

Full duplex technology enables transmission and reception of radio signals using a common antenna and transceiver. In full duplex communications, transmission signals and reception signals are communicated using the same time-frequency resource (e.g., using the same carrier frequency at the same time). Full duplex communication offers the possibility of double the communication capacity on a given bandwidth. However, in full duplex communication, interfering signal cancellation is important to maintain acceptable performance.

A typical full duplex massive MIMO array, or other antenna array structure, may contain a plurality of physically adjacent duplex transceiver antenna elements. These duplex transceiver antenna elements can generate self-interference, especially in a dense array, such as one meant for massive MIMO functionality, which may make full duplex operation impossible or difficult.

The present application describes examples of an antenna array having conductive structures which allow for a coupling path between diagonal antenna elements in the array and enable self-cancellation of cross polarity mutual coupling.

Figure 1A:
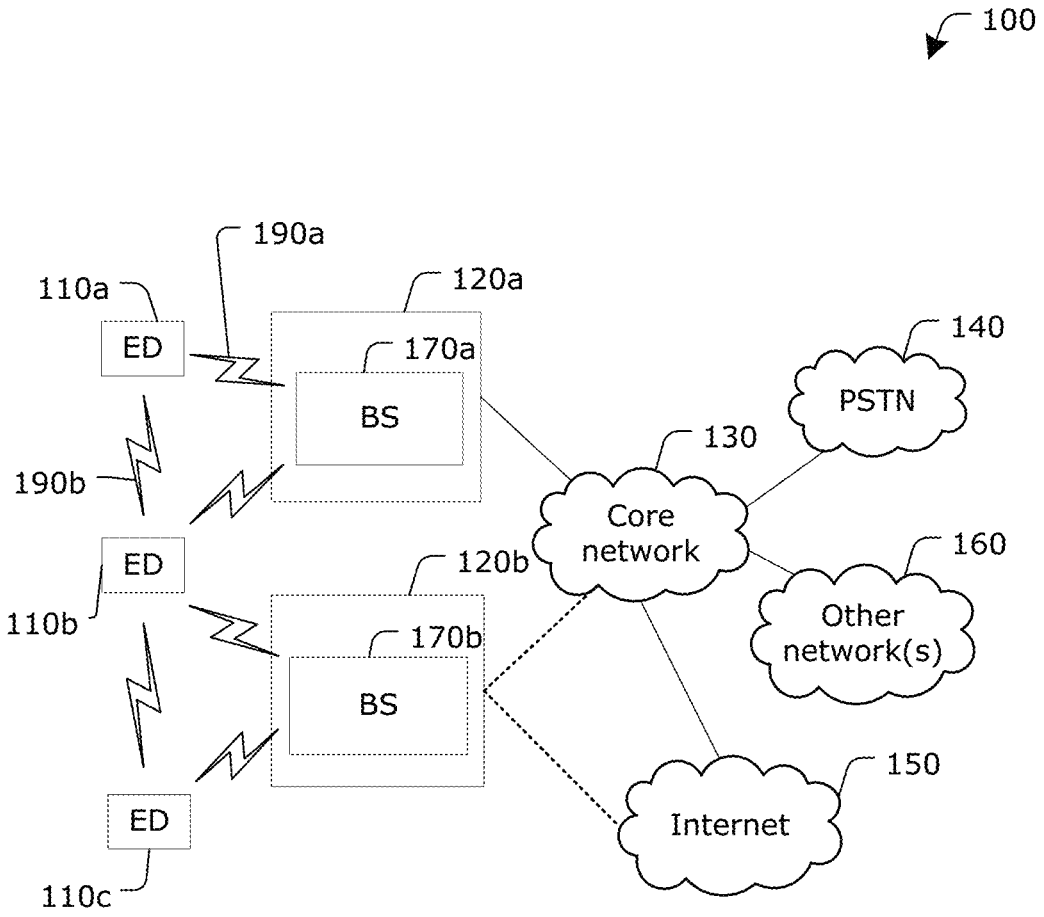
FIG. 1A is a schematic diagram of an example communication system suitable for implementing examples described herein.

FIG. 1A illustrates an example wireless communication system 100 (also referred to as wireless system 100) in which embodiments of the present disclosure could be implemented. In general, the wireless system 100 enables multiple wireless or wired elements to communicate data and other content. The wireless system 100 may enable content (e.g., voice, data, video, text, etc.) to be communicated (e.g., via broadcast, narrowcast, user device to user device, etc.) among entities of the system 100. The wireless system 100 may be suitable for wireless communications using 5G technology and/or later generation wireless technology (e.g., 6G or later). In some examples, the wireless system 100 may also accommodate some legacy wireless technology (e.g., 3G or 4G wireless technology).

In the example shown, the wireless system 100 includes electronic devices (ED) 110*a*-110*c* (generically referred to as ED 110), radio access networks (RANs) 120*a*-120*b* (generically referred to as RAN 120), a core network 130, a public switched telephone network (PSTN) 140, the internet 150, and other networks 160. In some examples, one or more of the networks may be omitted or replaced by a different type of network. Other networks may be included in the wireless system 100. Although certain numbers of these components or elements are shown in FIG. 1A, any reasonable number of these components or elements may be included in the wireless system 100.

The EDs 110 are configured to operate, communicate, or both, in the wireless system 100. For example, the EDs 110 may be configured to transmit, receive, or both via wireless communication channels. Each ED 110 represents any suitable end user device for wireless operation and may include such devices (or may be referred to) as a user equipment/device (UE), a wireless transmit/receive unit (WTRU), a mobile station, a fixed or mobile subscriber unit, a cellular telephone, a station (STA), a machine type communication (MTC) device, a personal digital assistant (PDA), a smartphone, a laptop, a computer, a tablet, a wireless sensor, or a consumer electronics device, among other possibilities. Future generation EDs 110 may be referred to using other terms.

In FIG. 1A, the RANs 120 include base stations (BSs) 170*a*-170*b* (generically referred to as BS 170), respectively. Each BS 170 is configured to wirelessly interface with one or more of the EDs 110 to enable access to any other BS 170, the core network 130, the PSTN 140, the internet 150, and/or the other networks 160.

For example, the BS 170*s* may include (or be) one or more of several well-known devices, such as a base transceiver station (BTS), a radio base station, a Node-B (NodeB), an evolved NodeB (eNodeB), a Home eNodeB, a gNodeB (sometimes called a next-generation Node B), a transmission point (TP), a transmit and receive point (TRP), a site controller, an access point (AP), or a wireless router, among other possibilities. Future generation BSs 170 may be referred to using other terms. Any ED 110 may be alternatively or additionally configured to interface, access, or communicate with any other BS 170, the internet 150, the core network 130, the PSTN 140, the other networks 160, or any combination of the preceding using the antenna system of the present disclosure. The wireless system 100 may include RANs, such as RAN 120*b*, wherein the corresponding BS 170*b* accesses the core network 130 via the internet 150, as shown.

The BSs 170 are examples of communication equipment that can be configured to implement some or all of the functionality and/or embodiments of the antenna array described herein. In the embodiment shown in FIG. 1A, the BS 170*a* forms part of the RAN 120*a*, which may include other BSs, base station controller(s) (BSC), radio network controller(s) (RNC), relay nodes, elements, and/or devices. Any BS 170 may be a single element, as shown, or multiple elements, distributed in the corresponding RAN, or otherwise. Also, the BS 170*b* forms part of the RAN 120*b*, which may include other BSs, elements, and/or devices. Each BS 170 transmits and/or receives wireless signals within a particular geographic region or area, sometimes referred to as a "cell" or "coverage area". A cell may be further divided into cell sectors, and a BS 170 may, for example, employ multiple transceivers to provide service to multiple sectors. In some embodiments there may be established pico or femto cells where the radio access technology supports such. A macro cell may encompass one or more smaller cells. In some embodiments, multiple transceivers could be used for each cell, for example using MIMO technology. The number of RANs 120 shown is exemplary only. Any number of RANs may be contemplated when devising the wireless system 100.

The BSs 170 communicate with one or more of the EDs 110 over one or more air interfaces 190*a* using wireless communication links (e.g. radio frequency (RF), microwave, infrared (IR), etc.) which may utilize the antenna array described herein in the antenna systems located therein. The EDs 110 may also communicate directly with one another via one or more sidelink air interfaces 190*b*. The interfaces 190*a* and 190*b* may be generally referred to as air interfaces 190. BS-ED communications over interfaces 190*a* and ED-ED communications over interfaces 190*b* may use similar communication technology. For example, the antenna arrays disclosed herein may be used for BS-ED communications and may also be used for ED-ED communications. The air interfaces 190 may utilize any suitable radio access technology. For example, the wireless system 100 may implement one or more channel access methods, such as code division multiple access (CDMA), time division multiple access (TDMA), frequency division multiple access (FDMA), orthogonal FDMA (OFDMA), or single-carrier FDMA (SC-FDMA) in the air interfaces 190. In accordance with examples described herein, the air interfaces 190 may utilize other higher dimension signal spaces, which may involve a combine of orthogonal and/or non-orthogonal dimensions.

The RANs 120 are in communication with the core network 130 to provide the EDs 110 with various services such as voice, data, and other services. The RANs 120 and/or the core network 130 may be in direct or indirect communication with one or more other RANs (not shown), which may or may not be directly served by core network 130, and may or may not employ the same radio access technology as RAN 120*a*, RAN 120*b* or both. The core network 130 may also serve as a gateway access between (i) the RANs 120 or EDs 110 or both, and (ii) other networks (such as the PSTN 140, the internet 150, and the other networks 160). In addition, some or all of the EDs 110 may include functionality for communicating with different wireless networks over different wireless links using different wireless technologies and/or protocols. Instead of wireless communication (or in addition thereto), the EDs 110 may communicate via wired communication channels to a service provider or switch (not shown), and to the internet 150. PSTN 140 may include circuit switched telephone networks for providing plain old telephone service (POTS). Internet 150 may include a network of computers and subnets (intranets) or both, and incorporate protocols, such as Internet Protocol (IP), Transmission Control Protocol (TCP), and User Datagram Protocol (UDP). EDs 110 may be multimode devices capable of operation according to multiple radio access technologies, and incorporate multiple transceivers necessary to support such.

Figure 1B:
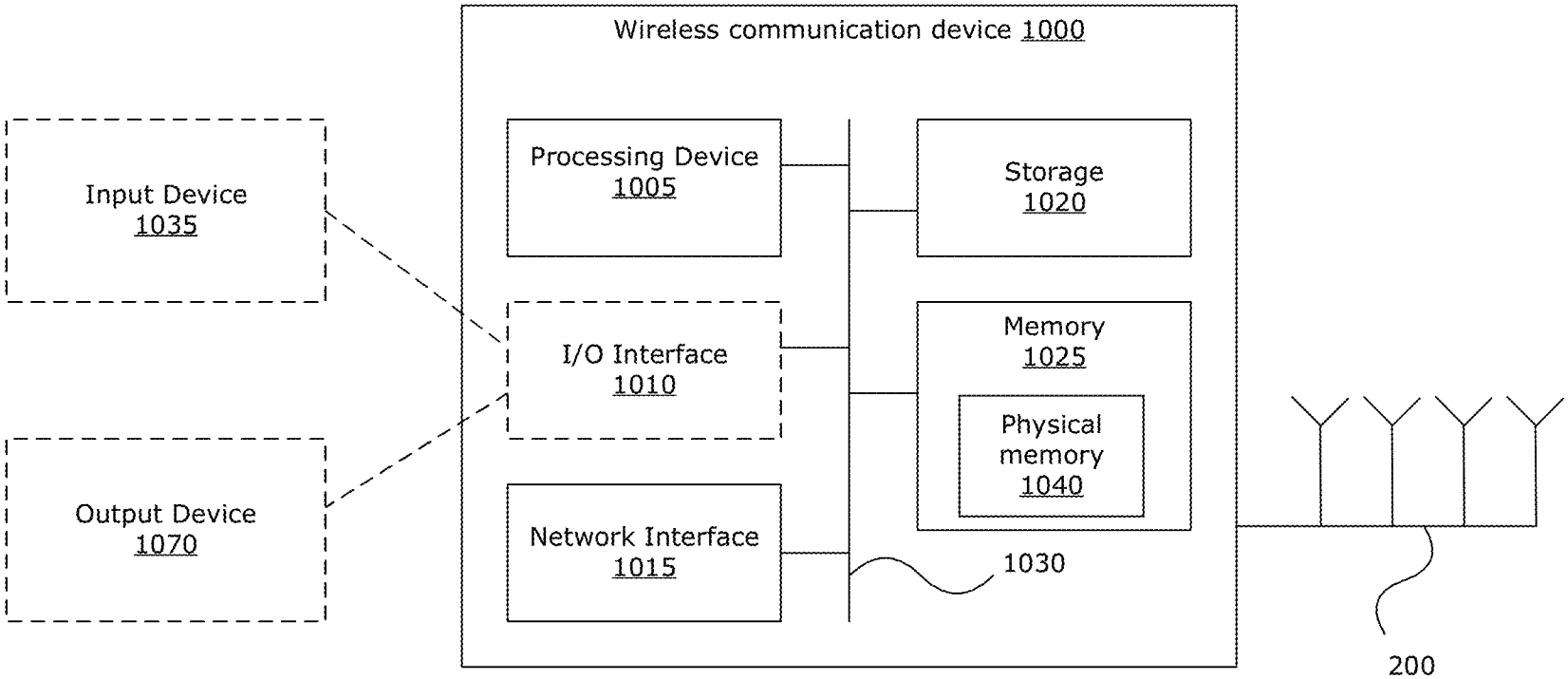
FIG. 1B is a schematic diagram of an example wireless communication device, in which an example of the disclosed antenna array may be implemented.

FIG. 1B is a schematic diagram of an example wireless communication device 1000, in which examples of the antenna array 200 described herein may be used. For example, the wireless communication device 1000 may be a BS 170 or an ED 110 in the wireless system 100. The wireless communication device 1000 may be used for communications within 5G communication networks or other wireless communication networks. Although FIG. 1B shows a single instance of each component, there may be multiple instances of each component in the wireless communication device 1000. The wireless communication device 1000 may be implemented using parallel and/or distributed architecture.

The wireless communication device 1000 may include one or more processing devices 1005, such as a processor, a microprocessor, an application-specific integrated circuit (ASIC), a field-programmable gate array (FPGA), a dedicated logic circuitry, or combinations thereof. The wireless communication device 1000 may also include one or more optional input/output (I/O) interfaces 1010, which may enable interfacing with one or more optional input devices 1035 and/or output devices 1070. The wireless communication device 1000 may include one or more network interfaces 1015 for wired or wireless communication with one or more networks of the wireless system 100 (e.g., an intranet, the Internet, a P2P network, a WAN and/or a LAN, and/or a Radio Access Network (RAN)). The network interface(s) 1015 may include one or more interfaces to wired networks and wireless networks. Wired networks may make use of wired links (e.g., Ethernet cable). The network interface(s) 1015 may provide wireless communication (e.g., full-duplex communications) via an example of the disclosed antenna array 200. The wireless communication device 1000 may also include one or more storage units 1020, which may include a mass storage unit such as a solid state drive, a hard disk drive, a magnetic disk drive and/or an optical disk drive.

The wireless communication device 1000 may include one or more memories 1025 that can include a physical memory 1040, which may include a volatile or non-volatile memory (e.g., a flash memory, a random access memory (RAM), and/or a read-only memory (ROM)). The non-transitory memory(ies) 1025 (as well as storage 1020) may store instructions for execution by the processing device(s) 1005. The memory(ies) 1025 may include other software instructions, such as for implementing an operating system (OS), and other applications/functions. In some examples, one or more data sets and/or modules may be provided by an external memory (e.g., an external drive in wired or wireless communication with the wireless communication device 1000) or may be provided by a transitory or non-transitory computer-readable medium. Examples of non-transitory computer readable media include a RAM, a ROM, an erasable programmable ROM (EPROM), an electrically erasable programmable ROM (EEPROM), a flash memory, a CD-ROM, or other portable memory storage.

There may be a bus 1030 providing communication among components of the wireless communication device 1000. The bus 1030 may be any suitable bus architecture including, for example, a memory bus, a peripheral bus or a video bus. Optional input device(s) 1035 (e.g., a keyboard, a mouse, a microphone, a touchscreen, and/or a keypad) and optional output device(s) 1070 (e.g., a display, a speaker and/or a printer) are shown as external to the wireless communication device 1000, and connected to optional I/O interface 1010. In other examples, one or more of the input device(s) 1035 and/or the output device(s) 1070 may be included as a component of the wireless communication device 1000. The processing device(s) 1005 may be used to control communicate transmission/reception signals to/from the antenna array 200. The processing device(s) 1005 may also be used to control beamforming and beam steering by the antenna array 200.

Figure 2:
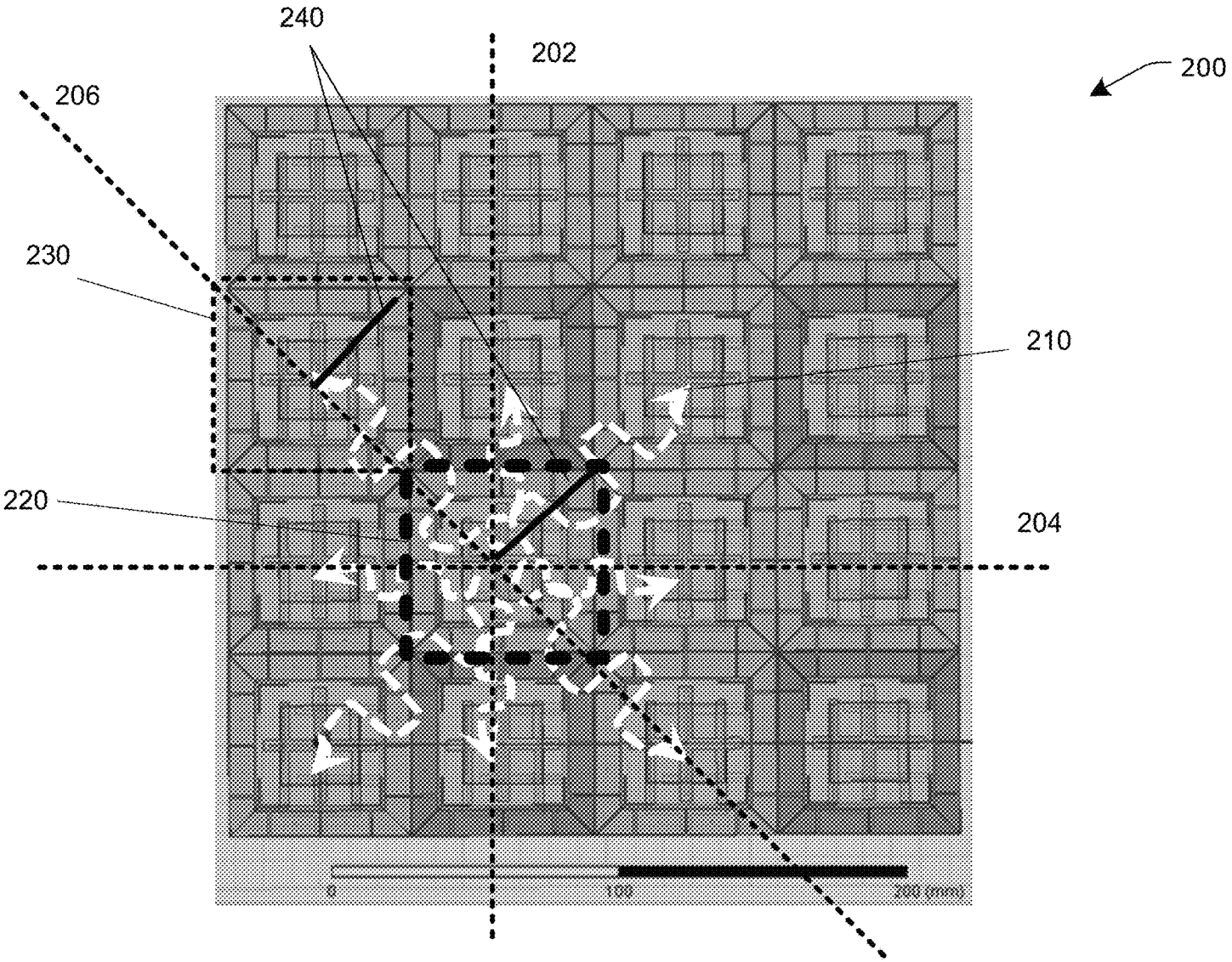
FIG. 2 illustrates an example antenna system, in which an example of the disclosed antenna array may be implemented.
Figure 3:
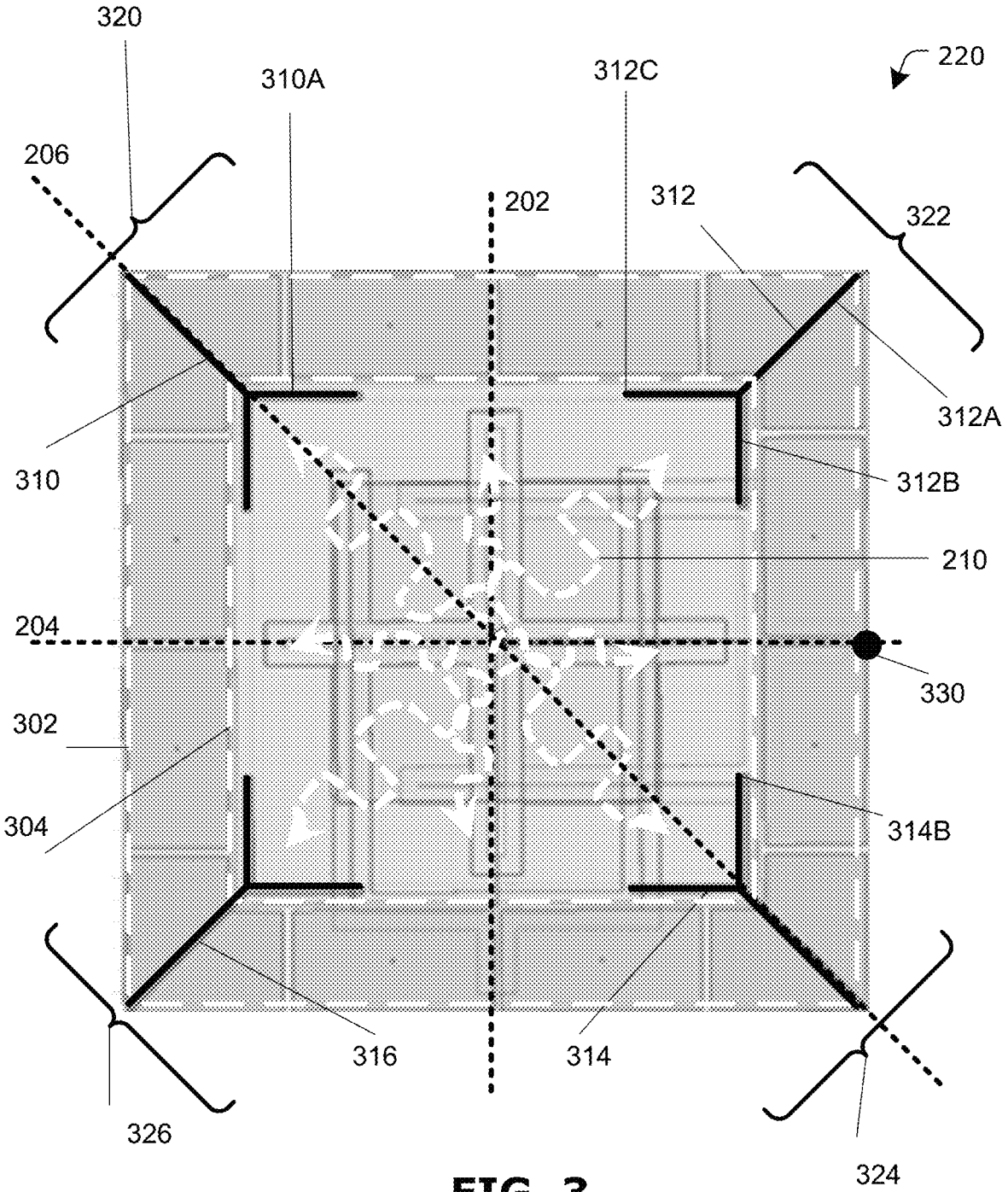
FIG. 3 illustrates an example antenna array element in accordance with examples described herein, with conductive structures.
Figure 4:
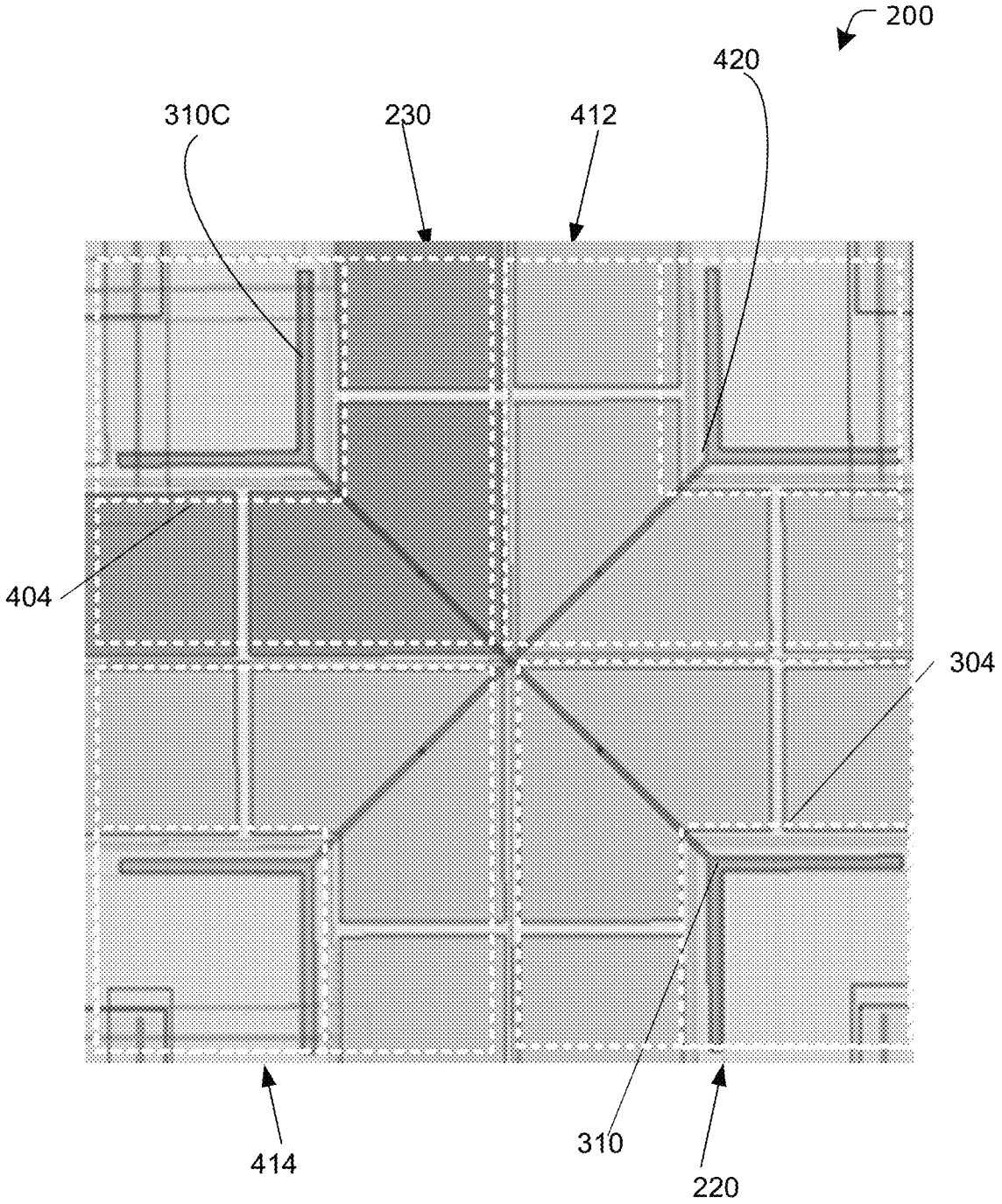
FIG. 4 illustrates an expanded view of an example antenna array with conductive structures, in which an example of the disclosed 2×2 antenna array may be implemented.

Reference is now made to FIGS. 2-4, showing an example of the disclosed antenna array 200 and the individual antenna elements therein. The following reference axes are shown in a Cartesian plane: a first axis 202, a second axis 204 and a diagonal axis 206. The first axis 202 is perpendicular to the second axis 204, and the diagonal axis 206 is also shown as intersecting the intersection of the first axis 202 and the second axis 204.

Referring to FIG. 2, the antenna array 200 comprises a plurality of antenna elements, which in this example are arranged in an N×M array. For example, in the example embodiment shown, the first antenna element 220 is shown on as being centered on the intersection of the first axis 202 and the second axis 204, while the second antenna element 230 is shown as being diagonally adjacent to the second antenna element 230. The diagonals of the first and second antenna elements 220, 230 share the same diagonal axis 206.

The antenna elements of the antenna array 200 can be arranged in a variety of patterns. In example embodiments, the antenna elements of the antenna array 200 are arranged in a half-lambda pitch, wherein the distance separating diagonally adjacent antenna elements is half of the signal wavelength A of the intended frequency of operation. For example, distance 240, shown in FIG. 2, may be configured to be half of the signal wavelength A of the operating frequency, such that the distance from one antenna element to another diagonally-adjacent antenna element is equal to one signal wavelength A. In some example embodiments, the antenna elements of the antenna array 200 are arranged in a grid-like fashion, as shown in FIG. 2. In other example embodiments, the grid-like fashion can include a non-rectangular shape (e.g., having rows/columns with different numbers of antenna elements 230) defined by a constituent grid-like antenna array 200.

The antenna array 200 may be capable of full duplex communication. The antenna array 200, when in operation, contains antenna elements which are transmitting, and antenna elements which are simultaneously receiving signal.

The antenna elements themselves, such as the first antenna element 220, may be a variety of shapes. The antenna elements can be symmetrical about a plane. In example embodiments, the first antenna element 220, and/or the plurality of antenna elements as a whole and/or the radiating elements therein may be circular, square or polygonal. In example embodiments, the antenna elements are any shape conducive to arranging the antenna elements in a half lambda pitch, as disclosed above.

In FIG. 2, when the first antenna element 220 transmits a signal, there is cross polarity mutual coupling with other antennal elements in a vertical direction coinciding with the first axis 202, a horizontal direction coinciding with the second axis 204, and along the diagonal axis 206 or in a direction mirror imaged to the diagonal axis 206. The mutual coupling in the vertical or horizontal directions tend to be relatively weak (e.g., −65 dB or less in power). However, the mutual coupling in the diagonal directions tend to be relatively strong (e.g., about −40 dB in power).

In example embodiments, a plurality of conductive structures are introduced into the antenna array 200, with the conductive structures extending diagonally between diagonally adjacent antenna elements (e.g., between the first and second antenna elements 220, 230). The conductive structures form coupling paths between the diagonally adjacent antenna elements. The diagonal coupling paths enable coupling between the diagonally adjacent antenna elements that is equal in amplitude but 180 degrees out of phase with the cross polarity mutual coupling in the diagonal directions.

The conductive structures in this configuration help to achieve reduction or nulling of the port-to-port couplings between the diagonally adjacent antenna elements.

The antenna elements are supported by a substrate structure (or simply substrate), and each antenna element includes a radiating patch element.

Referring now to FIG. 3, the first antenna element 220 is shown. In example embodiments, the first antenna element 220 may contain a plurality of conductive structures, including a first conductive structure 310, a second conductive structure 312, a third conductive structure 314, and a fourth conductive structure 316 (the "conductive structures"). The conductive structures, shown in bold for clarity, provide coupling paths between adjacent diagonal antenna elements (as described below).

The conductive structures may be made of any material capable of establishing a coupling path with an adjacent diagonal antenna element. For example, the conductive structures can be made of copper, aluminum, or other metals, or any non-metallic conductive materials.

In FIG. 3, a top-down view of antenna element 220 is shown. In some embodiments, for example, the first antenna element 220 has an outer perimeter 302, shown as a white dotted line, and a first inner perimeter 304, shown as a white dotted line for clarity. The portion of the antenna element 220 encapsulated by the first inner substrate perimeter 304 is the portion of that is superimposed by the radiating patch element (and which may be referred to herein as the inner portion of the antenna element 220). The area between the outer perimeter 302 and the first inner substrate perimeter 304 is referred to herein as the substrate portion of the antenna element 220, and defines the portion of the antenna element not superimposed by the radiating patch element. Similarly, an inner portion and a substrate portion may be defined for the second antenna element 230, and each other antenna element of the antenna array 200.

The outer perimeters of the antenna elements may have any number of edges which allow for the creation of different possible shapes of antenna elements. For example, the outer perimeter 302 in some embodiments has four edges where the first antenna element 220 is a square or rectangular shape. In example embodiments, the first antenna element 220 is in a polygon shape, and the outer perimeter 302 may have an odd or even number of edges. In example embodiments, the outer perimeter 302 has only one edge, and the antenna element 220 is a circular or oval shape.

In example embodiments, the conductive structures may have different elements, including arms, which extend in different directions and which may increase the nulling effectiveness. For example, in FIG. 3, the second conductive structure 312 has a diagonally extending portion 312A, which extends between the first antenna element 220 and a diagonally adjacent antenna element (not shown). The second conductive structure 312 may further comprise arm(s) 312B and 312C. The arms 312B and 312C may be positioned in the inner portion of the antenna element 220, and may extend proximate to the first inner perimeter 304, increasing the amount of the inner portion that is covered by the arms 312B and 312C. In example embodiments, the arms 312B and 312C are proximate to the first inner perimeter 304 and respectively parallel to the vertical axis 202 and the horizontal axis 204. In some example embodiments, the arms 312B and 312C may be curved or have a curved geometry. In some examples, there may be only one arm (e.g., only arm 312B) extending along one axis. In some examples, the arms 312B and 312C may together form a single arc.

The length of the arms 312B and 312C may be varied, or in example embodiments the length of the arms 312B and 312C may be substantially equal. A first conductive structure 310 may have arms of different lengths than that of the second conductive structure 312, and so forth. The arms 312B and 312C may extend proximate to the first inner perimeter 304, however they do not extend into contact with another conductive structure. For example, arms 312B and 312C may extend proximate to the first inner perimeter 304, however the arm 312C may not extend past a midpoint 330.

The above discussion pertaining to conductive structure 312 similarly pertains to all conductive structures, including the first conductive structure 310. For example, the first conductive structure may have an arm element 310A extending proximate to the first inner perimeter 304.

In example embodiments, where the first inner perimeter 304 is polygonal, the substrate portion proximate to a corner in the polygonal shape can be considered a "corner." A corner can also be defined by the area of the substrate portion that is proximate to a corner of the radiating patch element. In the example embodiment shown, first antenna element 220 comprises a first corner 320, a second corner 322, a third corner 324 and a fourth corner 326. Each conductive structure 310, 312, 314, 316 may be positioned in the vicinity of a respective corner 320, 322, 324, 326.

FIG. 4 is a close-up view of respective corners of four antenna elements (namely, first antenna element 220, second antenna element 230, third antenna element 412 and fourth antenna element 414) that are adjacent to each other (e.g., in a 2×2 grid arrangement). Referring to FIG. 4, the first conductive structure 310, in example embodiments, is connected proximate to the inner perimeter 304 of the first antenna element 220, extends across the substrate portion of the first antenna element 220, extends across the substrate portion of the second antenna element 230 and is connected proximate to the inner substrate perimeter 404 of the second antenna element 230.

In example embodiments, the first conductive structure 310 may have at least one arm element 310C extending proximate to the second inner substrate perimeter 404. The at least one arm element 310C extending proximate to the second inner substrate perimeter 404 may have a curved geometry (not shown).

The first antenna element 220 is connected to the first conductive structure 310, as is the second antenna element 230, which enables a diagonal coupling path between the two antenna elements. A signal generated by the first antenna element 220 would be coupled to the second antenna element 230 by the first conductive structure 310, and the coupled signal would arrive at the second antenna element 230 180 degrees out of phase relative to a cross polarity mutual coupling from the first antenna element 310 to the second antenna element 230 over the air. The first conductive structure 310 may thus reduce the diagonal cross polarity mutual coupling between the first antenna element 220 and the second antenna element 230.

In example embodiments, the length and/or thickness of the first conductive structure 310 may be designed to provide a coupling path between the diagonally adjacent first antenna element 220 and the second antenna element 230, such that the coupled signal along the conductive structure 310 is equal in amplitude but 180 degrees out of phase the diagonal cross polarity mutual coupling between the first antenna element 220 and the second antenna element 230.

Additional conductive structures can be configured similarly to the first conductive structure 310 as discussed above, to provide additional coupling paths with respect to other diagonally adjacent antenna elements, in order to reduce or nullify the port to port diagonal cross polarity mutual couplings. For example, a second conductive structure 420 may similarly provide a conductive path between the third and fourth antenna elements 412, 414, to reduce or cancel the diagonal cross polarity mutual coupling between the third and fourth antenna elements 412, 414.

Figure 5:
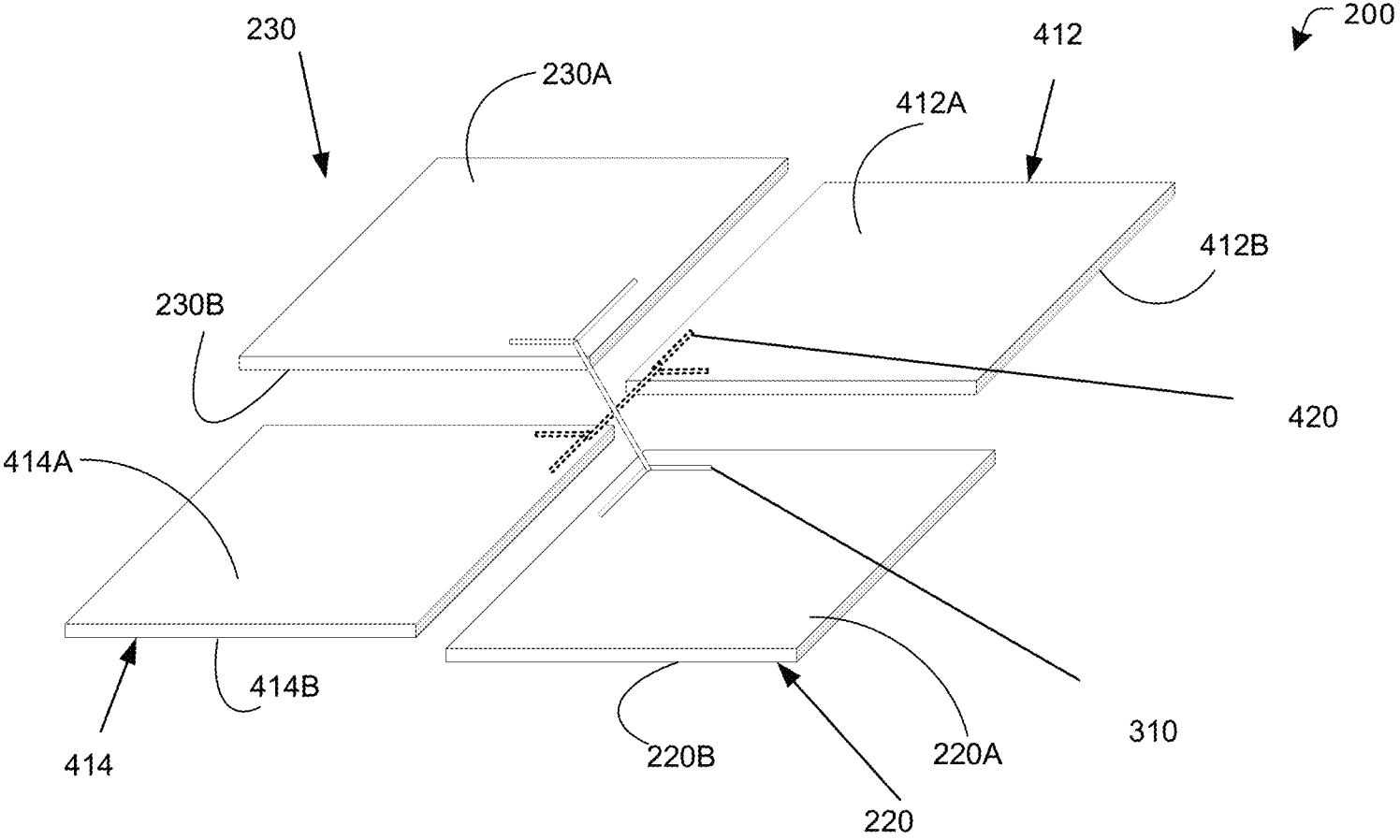
FIG. 5 illustrates an example antenna array, in accordance with examples described herein, having with conductive structures in a 2×2 antenna element grid.

FIG. 5 shows an orthogonal exploded view of the portion of the antenna array 200 that is shown in FIG. 4. The view in FIG. 5 shows portions of four antenna elements, specifically portions of the first antenna element 220, the second antenna element 230, the third antenna element 412, and the fourth antenna element 414 arranged in a 2×2 grid (generally referred to as the "antenna elements").

The antenna elements are coplanar and supported by a substrate (e.g., a printed circuit board (PCB) substrate). The antenna elements may each have a patch radiating element, which together may define an element patch plane. Where more than one conductive structure is required to be located in the same area between a plurality of diagonally adjacent antenna elements, the conductive structures can be placed on opposite sides of the substrate. The antenna elements 220, 230, 412, 414, respectively, have a first antenna element first side 220A, second antenna element first side 230A, third antenna element first side 412A, and a fourth antenna element first side 230A on a first side of the substrate. The antenna elements also each have a respective second side 220B, 230B, 412B, 414B, on a second side of the substrate opposite to the first side. The first conductive structure 310, which diagonally extends between the first antenna element 220 and the second antenna element 230, is shown on the first side of the substrate. The second conductive structure 420, shown in a dotted line, is located on the second side of the substrate. The first and second conductive structures 310, 420 are in this way configured to be located in the same area, but on opposite sides of the substrate. Thus, the conductive structures 310, 420 are located below the element patch plane and does not significantly increase the thickness of the antenna array 200. This is further illustrated in FIG. 4, showing a 2D overhead representation of a portion of the antenna array 200. In FIG. 4, the first conductive structure 310 is shown on the first side of the substrate, and the second conductive structure 420 is on the opposite second side of the substrate (note that the second conductive structure 420 would be hidden from view, as indicted by the use of dashed lines).

Examples of the disclosed antenna array may be suitable for used in a full-duplex antenna array, including a closely-packed array configuration, for example for use in a base station or access point of a wireless communication network.

A network of the disclosed conductive structures can be arranged above a reflector of an antenna array, having dual polarity antenna elements, and be used to introduce independent coupling paths between diagonally adjacent antenna elements. In particular, these introduced coupling paths between diagonally placed antenna elements are not placed along the vertical or horizontal lines of symmetry of the elements. These independent coupling paths are equal in amplitude but 180 degrees out of phase with the inherent antenna couplings, and so reduction or nulling of the cross polarity port-to-port couplings may be achieved.

A network of the disclosed conductive structures creates the independent coupling in the full two dimensions of the antenna array. In some examples, high isolation and pure polarization antenna elements can be used in antenna array.

A network of the disclosed conductive structures in an antenna array may help to achieve reduced coupling between antenna elements in a dense array, such as for massive MIMO operation. The network of conductive structures may not significantly increase the overall volume of the antenna array and may only add incremental complexity to the antenna array.

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure. For examples, although certain sizes and shapes of the disclosed antenna elements and/or antenna array have been shown, other sizes and shapes may be used.

All values and sub-ranges within disclosed ranges are also disclosed. Also, while the systems, devices and processes disclosed and shown herein may comprise a specific number of elements/components, the systems, devices and assemblies could be modified to include additional or fewer of such elements/components. For example, while any of the elements/components disclosed may be referenced as being singular, the embodiments disclosed herein could be modified to include a plurality of such elements/components. The subject matter described herein intends to cover and embrace all suitable changes in technology.

The invention claimed is:

1. An antenna array capable of full duplex communication, comprising:

a first dual polarity antenna element, the first dual polarity antenna element having a first diagonal axis;

a second dual polarity antenna element, the second dual polarity antenna element having the first diagonal axis in common with the first dual polarity antenna element, the second dual polarity antenna element being adjacent to the first dual polarity antenna element along the first diagonal axis; and a first conductive structure, extending between the first and second dual polarity antenna elements along the first diagonal axis, and forming a first coupling path between the first and the second dual polarity antenna elements such that at least a portion of a signal generated by the first dual polarity antenna element is coupled, via the first coupling path, to the second dual polarity antenna element to at least reduce cross polarity mutual coupling between the first dual polarity antenna element and the second dual polarity antenna element, the first conductive structure having a length such that the signal generated by the first dual polarity antenna element arrives, via the first coupling path, at the second dual polarity antenna element 180° out of phase relative to an over the air signal generated by the first dual polarity antenna element.

2. The antenna array of claim 1, wherein the first and second dual polarity antenna elements are supported by a substrate, and the first conductive structure is located on a first side of the substrate.

3. The antenna array of claim 1, wherein the first conductive structure is a copper conductive structure.

4. The antenna array of claim 1, further comprising:

a third dual polarity antenna element;

a fourth dual polarity antenna element;

the first dual polarity antenna element, second dual polarity antenna element, third dual polarity antenna element, and fourth dual polarity antenna element forming a 2×2 grid; and a second conductive structure, extending between the third and fourth dual polarity antenna elements along a second diagonal axis that is shared by the third and fourth antenna elements, and forming a second coupling path between the third and the fourth dual polarity antenna elements such that at least a portion of a signal generated by the third dual polarity antenna element is coupled, via the second coupling path, to the fourth dual polarity antenna element to at least reduce cross polarity mutual coupling between the third dual polarity antenna element and the fourth antenna element.

5. The antenna array of claim 4, wherein:

the first, second, third and fourth dual polarity antenna elements are supported by a substrate;

the first conductive structure is located on a first side of the substrate; and the second conductive structure is located on a second side of the substrate.

6. The antenna array of claim 1, wherein the first and the second dual polarity antenna elements are supported by a substrate, and the first conductive structure is connected to a first portion of the first dual polarity antenna element that is superimposed by a first radiating patch element of the first antenna element, and to a second portion of the second dual polarity antenna element that is superimposed by a second radiating patch element of the second antenna element.

7. The antenna array of claim 6 wherein the first conductive structure has at least a first arm extending proximate to a first perimeter of the first portion of the first dual polarity antenna element, and has at least a second arm extending proximate to a second perimeter of the second portion of the second dual polarity antenna element.

8. The antenna array of claim 7, wherein the first arm and the second arm each has a curved geometry.

9. The antenna array of claim 7, wherein the first arm extends along a first edge of the first perimeter of the first portion of the first dual polarity antenna element short of a midpoint of the first edge, and wherein the second arm extends along a second edge of the second perimeter of the second portion of the second dual polarity antenna element short of a midpoint of the second edge.

10. The antenna array of claim 1, wherein:

the first dual polarity antenna element comprises a first corner;

the second dual polarity antenna element comprises a second corner;

the first corner is adjacent and closest to the second corner; and the first conductive structure is connected proximate to the first corner and proximate to the second corner.

11. The antenna array of claim 10, wherein the first and the second dual polarity antenna elements are supported by a substrate, and the first conductive structure extends along a first inner substrate perimeter of the first dual polarity antenna element and a second inner substrate perimeter of the second dual polarity antenna element.

12. The antenna array of claim 10, wherein the first dual polarity antenna element has four corner portions each containing a respective conductive structure.

13. The antenna array of claim 1, wherein the length of the first conductive structure is equal to half an operating wavelength of the antenna array.

14. An antenna array capable of full duplex communication, comprising:

a plurality of antenna elements, arranged in a grid pattern, the plurality of antenna elements including at least a first antenna element and a second antenna element, the first and second antenna elements having a common diagonal axis, the first and second antenna elements being adjacent to each other along the diagonal axis; and a plurality of conductive structures, each conductive structure extending between a respective pair of diagonally adjacent antenna elements of the plurality of antenna elements to form a respective coupling path between the respective pair of diagonally adjacent antenna elements such that at least a portion of a signal generated by one antenna element of the respective pair of diagonally adjacent antenna elements is coupled, via the respective coupling path, to another antenna element of the respective pair of diagonally adjacent antenna elements to at least reduce cross polarity mutual coupling between the respective pair of diagonally adjacent antenna elements;

wherein a first conductive structure, of the plurality of conductive structures, extending between the first and second antenna elements, has a length such that the signal generated by the first antenna element arrives, via the coupling path formed by the first conductive structure, at the second antenna element 180° out of phase relative to an over the air signal generated by the first antenna element.

15. The antenna array of claim 14, wherein the length of the first conductive structure is equal to half an operating wavelength of the antenna array.

16. The antenna array of claim 14, wherein each of the plurality of antenna elements is shaped to have four corner portions, and wherein each of the plurality of conductive structures extends between diagonally adjacent corners of the respective pair of diagonally adjacent antenna elements.

17. The antenna array of claim 15, wherein the first conductive structure is connected to a first portion of the first antenna element that is superimposed by a first radiating patch element of the first antenna element, and to a second portion of the second antenna element that is superimposed by a second radiating patch element of the second antenna element.

18. The antenna array of claim 17 wherein the first conductive structure has at least a first arm extending proximate to a first perimeter of the first portion of the first antenna element, and has at least a second arm extending proximate to a second perimeter of the second portion of the second antenna element.

19. The antenna array of claim 18, wherein the first arm and the second arm each has a curved geometry.

20. The antenna array of claim 18, wherein the first arm extends along a first edge of the first perimeter of the first portion of the first antenna element short of a midpoint of the first edge, and wherein the second arm extends along a second edge of the second perimeter of the second portion of the second antenna element short of a midpoint of the second edge.

* * * * *